US005077991A

United States Patent [19]

Stickel et al.

[11] Patent Number: 5,077,991

[45] Date of Patent: Jan. 7, 1992

[54] LOCK MECHANISM FOR MULTI-COMPONENT DATA PROCESSING EQUIPMENT

[75] Inventors: Heinz Stickel, Groebenzell; Georg Altenhuber, Mering, both of Fed. Rep. of Germany

[73] Assignee: Siemens Aktiengesellschaft, Munich, Fed. Rep. of Germany

[21] Appl. No.: 391,153

[22] Filed: Aug. 8, 1989

[30] Foreign Application Priority Data

Aug. 8, 1988 [DE] Fed. Rep. of Germany ..... 8810093

[51] Int. Cl.[5] ..... E05B 47/00; E05B 73/00

[52] U.S. Cl. ..... 70/58; 70/277; 70/DIG. 30; 70/DIG. 52; 200/43.08

[58] Field of Search ..... 70/277, 279–282, 70/DIG. 30, 57, 58, DIG. 52; 292/144; 200/43.08, 43.04, 574

[56] References Cited

U.S. PATENT DOCUMENTS

| | | | |
|---|---|---|---|
| 234,592 | 11/1880 | Lemke | 292/144 |
| 870,216 | 11/1907 | Bennett et al. | 70/DIG. 52 X |
| 1,361,317 | 12/1920 | Dulczewski et al. | 292/144 X |
| 1,934,105 | 11/1933 | Totty | 70/DIG. 52 X |
| 4,640,108 | 2/1987 | Young | 70/280 X |
| 4,647,735 | 3/1987 | Sicher | 200/43.08 |
| 4,840,050 | 6/1989 | Gotanda | 70/279 X |
| 4,918,954 | 4/1990 | Stickel et al. | 70/57 X |

FOREIGN PATENT DOCUMENTS

| | | | |
|---|---|---|---|
| 8598 | 4/1902 | Austria | 70/277 |
| 1338 | 9/1988 | Fed. Rep. of Germany . | |
| 8054 | 10/1988 | Fed. Rep. of Germany . | |
| 1096881 | 2/1955 | France | 70/277 |

*Primary Examiner*—Lloyd A. Gall

*Attorney, Agent, or Firm*—Hill, Van Santen, Steadman & Simpson

[57] ABSTRACT

The present invention relates to a lock mechanism for data processing equipment. The lock mechanism can simultaneously switch the power supply on or off, lock or unlock the housing of the equipment, and lock or unlock a removable covering installed over a drive assembly. The lock mechanism has a leafspring to produce self-retaining and positively-engaged final positions of a pivoted lever lock. Attached to the lever lock are a plurality of swivel arms arranged and located to perform the simultaneous functions mentioned above. Further, the lock mechanism includes a lock bolt biased closed by a compression spring and actuated by one of the swivel arms.

11 Claims, 1 Drawing Sheet

LOCK MECHANISM FOR MULTI-COMPONENT DATA PROCESSING EQUIPMENT

TECHNICAL FIELD

This invention relates to a lock mechanism for multiple components of equipment used in data processing.

BACKGROUND OF THE INVENTION

It is often desirable for data processing equipment for example, personal computers, to be accessible for use only to authorized persons. Furthermore, individual components of such equipment should be protected against unauthorized removal. Given the proliferation of such equipment in the work place and the home and the resulting security requirements, it is no longer adequate after using the equipment to merely electrically switch the apparatus off with a key switch. In order to ensure the security of the equipment, the housing of the apparatus must also be simultaneously mechanically locked. With personal computers, there is the additional problem of separately protecting the drive assemblies for the external data carriers (floppy discs, etc.) so that data carriers potentially left behind in the drive assemblies after use cannot be removed. In order to achieve this, the equipment is provided with a covering that can be placed in front of the drive assemblies, this covering being advantageously lockable with the same key switch with which the apparatus can be electrically turned off and with which the housing can be mechanically locked.

German Utility Model Application G 88 07 737.3 discloses a lock mechanism that performs these functions and, in particular, is suitable for personal computers. This lock mechanism includes a simple pivoted lever lock similar to those used, for example, as cassette locks, and also includes a micro-switch and a lock bolt. Two pivoted levers are rigidly connected to the swiveling axis of the pivoted lever lock. The lock bolt is displaceable transversely relative to the swiveling axis and includes an engagement region for one of the pivoted levers. A tension spring is secured to the lock bolt, this tension spring pulling the bolt into a locking position. In the locking position, the lock bolt has a nose provided at its one end that engages an opening or recess in a covering. The covering can be positioned in front of the drive assemblies of the personal computer. The other end of the lock bolt includes an angled arm that, in the unlocking position of the lock bolt, actuates the micro-switches to turn the power supply on and off. When the swiveling axis of the pivoted lever lock swivels from the locking position into the unlocking position, one of the swivel arms of the pivoted lever lock contacts the engagement region of the lock bolt and pushes it back against the force of the tension spring. Simultaneously, the second swivel arm pivots out from behind a retaining element that is attached to the housing of the personal computer. When pivoted in the opposite direction, the swivel arm cooperating with the engagement region of the lock bolt slides out of the engagement region and releases lock bolt. Due to the force of the tension spring, the lock bolt is urged towards the locking position. Since the pivoted lever lock does not have its own spring assistance, the lock can potentially rest at an intermediate position between the respective final positions of the pivoted lever lock, even though the final positions are marked. For this reason, a tension spring is secured to one of the swivel arms to act as an over-dead-center spring, this tension spring pulling the pivoted lever lock into one or the other final position.

German Utility Model Application G 88 07 728.4 discloses another lock mechanism including a pivoted lever lock of the above described type having a leaf spring employed for spring assistance. This lock mechanism does not include a lock bolt.

SUMMARY OF THE INVENTION

The present invention relates to a lock mechanism for data processing equipment. The lock mechanism can simultaneously switch the power-supply on or off, lock or unlock the housing of the equipment, and lock or unlock a removable covering installed over a drive assembly. The lock mechanism has a leaf spring to produce self-retaining and positively-engaged final positions of a pivoted lever lock. Attached to the lever lock are a plurality of swivel arms arranged and located to perform the simultaneous functions mentioned above. Further, the lock mechanism includes a lock bolt biased closed by a compression spring and actuated by one of the swivel arms.

The lock mechanism of the present invention maintains self-retaining final positions without employing tension springs, and both switches the power supply of an apparatus on and off and simultaneously locks the housing of the apparatus and a displaceable covering installed near the housing. After actuation of the pivoted lever lock, the covering is still capable of being brought into the locking position. An over-dead-center leaf spring is employed for spring-assistance of the pivoted lever lock, and a compression spring is employed for biasing the lock bolt toward the locking position, both of these springs being easily mountable. The biasing force of the over-dead-center leaf spring effects self-retaining final positions of the pivoted lever lock.

The multiple utilization of a swivel arm as, first, a mechanical lock element and, second, as an actuation element for the contact element of the micro-switch reduces the number of swivel arms of the pivoted lever lock, and simplifies the mechanics of the lock mechanism. The angled end of the pivot arm that engages behind the retaining element of a part to be locked prevents catching or hanging-up on the retaining element during actuation. A bore provided in the mounting plate serves as receptacle for a nipple with which the mounting plate is secured against turning.

Since the housings and the frames of most data-processing apparatus are fabricated independently of one another, but various housings should be able to accommodate various frames, the housings are relatively liberally dimensioned, so that some play between the housing and the frame is usually still present after assembly. This dimensioning is particularly important in plastic housings that exhibit great manufacturing tolerances as a result of the materials used. In a standard mounting of a lock mechanism at the housing of an apparatus, the interaction of the lock bolt of the lock mechanism with the opening or recess of a displaceable covering installed at the housing is important. For this reason, the lock mechanism and the housing must be assembled together. A constant positional relationship between the individual frame and the individual housing, however, is thus required. After repair of the apparatus, the housing must always be put back in place with great care. It is therefore especially advantageous to mount the lock mechanism on the housing of the apparatus, since the lock bolt can then be correctly and finally aligned with the opening or recess. The alignment does not change even after the housing is removed from the frame. Overall, the spatial relationship between the housing part and the frame need not be as precise.

It is therefore a primary object of the instant invention to provide a locking mechanism that will simply and simultaneously move a lock bolt, actuate a micro-switch, and cooperate with a retaining element, in order to secure multi-component data processing equipment.

It is another object of this invention to provide a lock mechanism including a lock bolt that has a spring leg and a ramp bevel extending from its opposite ends, and a compression spring coaxially surrounding the spring leg to bias the lock bolt towards the locked position.

It is yet another object of the present invention to provide a lock mechanism mounted on the housing of one of the data processing components.

It is a further object of this invention to provide a lock mechanism with equiangularly disposed swivel arms.

It is yet another object of this invention to provide a lock mechanism having swivel arms whose free ends lie in different planes transverse to the pivot axis of the lever lock.

It is another object of the invention to provide a lock mechanism having a swivel arm the free end of which is angularly offset with respect to a plane transverse to the pivot axis of the lever lock.

It is yet another object of this invention to provide a lock mechanism mounted on a base plate, with the base plate including a bore adapted to accept a nipple that is stationary relative to the base plate.

In attainment of the foregoing objects, the present invention contemplates a lock mechanism for multiple components of a data processing system. The mechanism uses a key-operated lever lock that is pivotable between a locking position and an unlocking position. An over-dead-center leaf spring biases the lever lock towards one position or the other. The lever lock supports a plurality of swivel arms, each of which has one end rigidly secured to the lever lock and a second, free end extending radially away from the pivot axis of the lever lock. The lock mechanism includes a lock bolt which has an engagement region, and which reciprocates in response to the pivoting of the lever lock. In a preferred embodiment, the lock mechanism includes three swivel arms. The free end of the first swivel arm acts as a mount for one end of the over-center spring. The free end of the second arm actuates a micro-switch, in addition to cooperating with a retaining element on one of the components. The free end of a third swivel arm cooperates with the engagement region of the lock bolt to cause it to reciprocate. When the lever lock is in the locked position, the free end of the third swivel arm is outside the engagement region. These and other objects and advantages of the present invention will be apparent upon reference to the accompanying description when taken in conjunction with the following drawings.

DESCRIPTION OF THE PREFERRED EMBODIMENT

Figure 1:
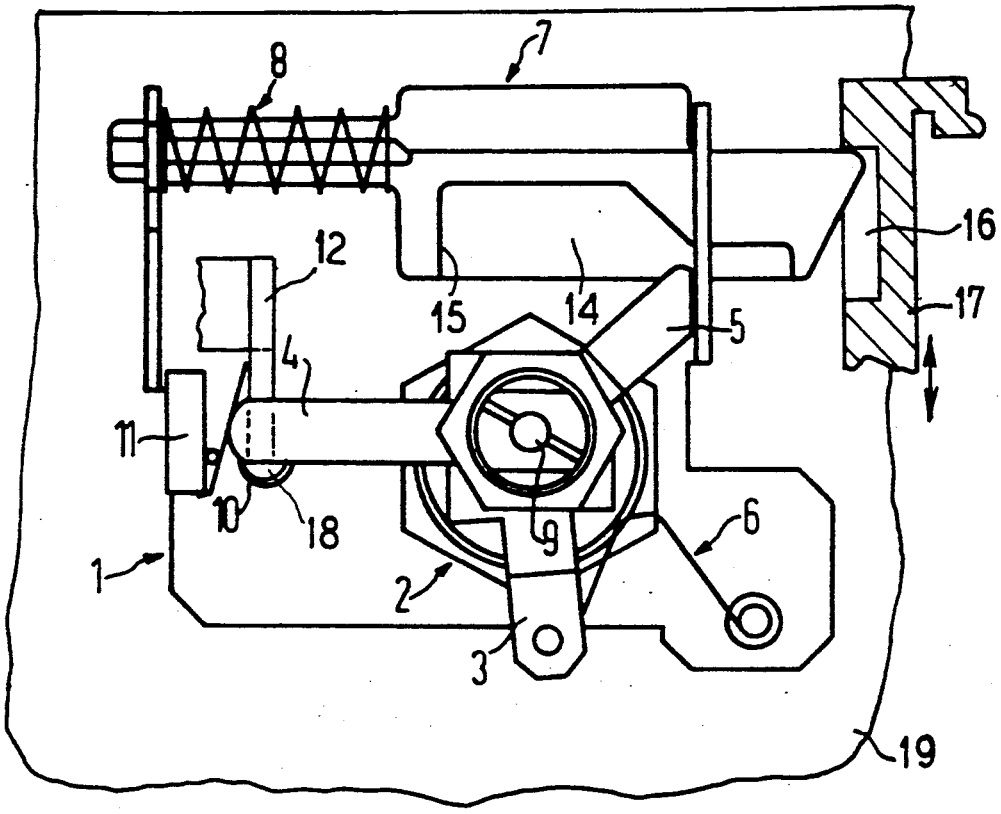
FIG. 1 shows a front view of a lock mechanism according to the present invention.
Figure 2:
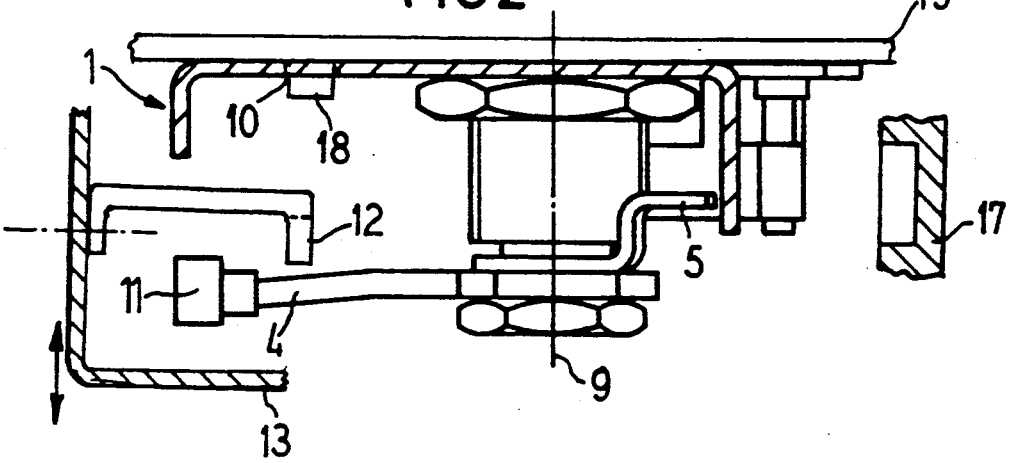
FIG. 2 shows a top view, in partial section, of the lock mechanism of FIG. 1.

The lock mechanism shown in FIGS. 1 and 2 is suitable, for example, for personal computers wherein the power supply should be switched on and off, and the housing, along with a displaceable covering installed at the housing, should be simultaneously capable of being individually locked. What is meant by power supply is not necessarily only the power supply for the entire apparatus; "power supply" can also refer to a special individual circuit. In a personal computer, for example, the power supply of the keyboard could be electrically isolated from that of the other components, so that the risk of data loss due to an inadvertent switch-off is greatly reduced.

The illustrated lock mechanism of FIG. 1 is shown in the locking position. All component parts belonging to the lock mechanism are mounted on a mounting plate 1, namely, a pivoted lever lock 2 including three swivel arms 3–5, an over-dead-center spring 6, a lock bolt 7, a compression spring 8, and a micro-switch 11. The swivel arms 3–5 of the pivoted lever lock 2 are rigidly connected to the pivot axis 9 of the pivoted lever lock 2. The individual swivel arms are arranged substantially equiangularly around the pivot axis 9. The lever lock can be turned 90 degrees, around its pivot axis, in counter-clockwise direction. After such pivoting, the lever lock 2 (and thus the entire lock mechanism) is situated in the unlocking position. The over-dead-center spring 6 is secured to the free end of the first swivel arm 3. It is fashioned as a leaf spring bent into a generally V-shape. Its spring tension provides the lever lock 2 with two stable end positions that are also self-retaining. After the lever lock 2 has been moved more than halfway between its end positions, the lock will not remain in an intermediate position, since every intermediate position is converted into one of the two final positions by the biasing force of the over-dead-center spring 6. The leaf spring has rolled-up ends, so that, compared to a coil spring loaded for tension, they can be very easily mounted. In the embodiment shown, the spring ends are slipped into pin-like projections that are provided, first, at the free end of the swivel arm 3, and, second, at the mounting plate 1. A further advantage of the leaf spring is that it can be arranged in the space between the mounting plate 1 and the swivel arm 3, thus providing the lock mechanism with a low mounting depth.

The second swivel arm 4 serves as a locking element for a first part 13 to be locked in that it engages behind a retaining element 12 of the first part 13 to be locked. When the lever lock 2 is pivoted to the unlocking position, the swivel arm 4 emerges laterally from behind the retaining element 12 of the first part 13 to be locked and releases the locked first part 13. For example, the housing swivel arm could engage a retaining element on housing of a personal computer. The housing would thus be locked, and consequently more difficult for unauthorized people to remove. Due to variations in manufacturing tolerances of some equipment housings, locking elements of the prior art often catch and remain hung up on retaining elements behind which they are to engage. In order to avoid this, the free end of the swivel arm 4 is bent slightly away from the retaining element 12 so that said swivel arm is angularly offset from a plane transverse to the pivot axis 9 (FIG. 2). The swivel arm 4 also serves to actuate the contact element of a micro-switch 11. To that end, the micro-switch 11 is mounted in proximity to the free end of the swivel arm 4 such that the free end of the swivel arm 4 presses against the contact element of the micro-switch 11 in the locking position without impeding its pivot motion into the unlocking position.

The third swivel arm 5 interacts with the lock bolt 7. The lock bolt 7 has a main body with an engagement region 14 in the form of an engagement depression in which the swivel arm 5 is located when the lever lock is in the unlocking position. In the locking position, the swivel arm 5 is located outside of the engagement region. The lock bolt 7 reciprocates transversely relative to the swiveling axis 9 of the pivoted lever lock 2. Upon movement of the swivel arm 5 into the engagement area of the lock bolt 7, the swivel arm 5 presses against a support 15 and the lock bolt 7 is thrust back against the bias of the compression spring 8 and is held fast. The compression spring 8, coaxially surrounds a spring leg of the lock bolt 7. On the opposite end of the lock bolt 7 is fashioned a projection in the shape of a ramp bevel, this ramp bevel engaging an opening or recess 16 of a covering 17 that is displaceable transversely relative to the longitudinal axis of the lock bolt 7 when it is in the locking position. Due to the shape of the ramp bevel, the lock bolt 7, during locking of the covering 17, is briefly pushed back against the force of the compression spring 8 and then engages the opening or recess 16, of the covering 17.

The spring leg and the ramp bevel of the lock bolt 7 are each of smaller cross-section than the main body. The spring leg and the ramp bevel pass through openings in portions of the mounting plate 1 that are bent perpendicularly relative to the plane of the rest of the mounting plate 1. The inside walls of the openings form guide walls for the longitudinally displaceable lock bolt 7. The transition locations at both sides of the main body, where it attaches to the spring leg and ramp bevel, form shoulders that can abut the perpendicularly-bent sub-regions of the mounting plate 1, thus defining the limits of reciprocation of the lock bolt. Between the transition location of the center region of the lock bolt 7 and the perpendicularly-bent sub-region of the mounting plate 1, the compression spring 8 coaxially surrounds the spring leg. One end of the compression spring 8 abuts against the mounting plate 1, and a second end abuts against a supporting shoulder of the lock bolt 7. Due to the biasing force of the compression spring, the lock bolt 7 is always urged in the direction of the locking position. The mounting of the compression spring 8 is simple since it merely has to be slipped onto the spring leg and need not be hooked in under tensile stress, as in the case of a tension spring.

A bore 10 is provided in the mounting plate 1, this bore 10 serving as receptacle for a nipple 18 that projects out of a fastening wall 19, and that secures the lock mechanism against turning relative to the fastening wall 19.

Although this invention has been illustrated and described in connection with a particular embodiment, it will become apparent to one of skill in the art that various changes may be made therein without departing from the scope and spirit of the invention as set forth in the appended claims.

We claim:

1. A lock mechanism for multi-component data processing equipment, said lock mechanism comprising the following:

a key-operated lever lock, said lever lock being pivotable between a locking position and an unlocking position;

an over-dead-center spring comprising a leaf spring biasing said lever lock towards either of said positions;

a plurality of swivel arms, each having a first end rigidly secured to said lever lock, and a second, free end extending radially from a pivot axis of said lever lock;

a micro-switch actuated by operation of said lever lock;

a bolt comprising an engagement region, said lock bolt reciprocating in response to the pivoting of said lever lock; and wherein the free end of a first swivel arm comprises mounting means for an end of the over-dead-center spring;

wherein the free end of a second swivel arm actuates said micro-switch and cooperates with a retaining element of a component of the data processing equipment; and wherein the free end of a third swivel arm cooperates with said engagement region to actuate said lock bolt.

2. The lock mechanism of claim 1, further wherein the free end of said third swivel arm is located outside said engagement region when said lever lock is in the locked position, and located against a support inside said engagement region when said lever lock is in the unlocked position.

3. The lock mechanism of claim 2, further wherein:

said lock bolt further comprises a spring leg and a ramp bevel extending from opposite ends of a main body of said lock bolt;

said lock mechanism further comprises a compression spring coaxially surrounding said spring leg;

said compression spring has a first end abutting said main body, and a second end abutting a supporting shoulder that is stationary with respect to said lock bolt; and said compression spring biases said lock bolt towards a position corresponding to the locked position of said lever lock.

4. The lock mechanism of claim 3, further wherein said lock mechanism is mounted on a part of a housing of the data processing equipment.

5. The lock mechanism of claim 4, further wherein said swivel arms are disposed substantially equiangularly around the pivot axis of said lever lock.

6. The lock mechanism of claim 5, further wherein at least the free ends of said swivel arms are located in different planes transverse to said pivot axis.

7. The lock mechanism of claim 6, further wherein the engagement region of said lock bolt comprises an engagement depression.

8. The lock mechanism of claim 7, further wherein the free end of said second swivel arm is angularly offset from a plane transverse to said pivot axis.

9. The lock mechanism of claim 8, further wherein said lock mechanism is secured to a mounting plate.

10. The lock mechanism of claim 9, further wherein said mounting plate comprises a bore adapted to accept a nipple that is stationary relative to the mounting plate.

11. A lock mechanism for data processing equipment, said lock mechanism comprising the following:

a key-operable pivoted lever lock that assumes a locking position and an unlocking position assisted by an over-dead-center spring;

a plurality of swivel arms rigidly secured to a pivot axis of said lever lock and directed radially out;

a micro-switch actuated by operation of said lever lock;

a lock bolt having an engagement region;

wherein the over-dead-center spring comprises a generally V-shaped leaf spring having a first rolled end that is secured to a pin-like projection provided on one end of one of said swivel arms, and a second rolled end secured to a pin-like projection disposed on a mounting plate of said lock mechanism;

wherein one end of a first one of said swivel arms is allocated to a retaining element of a first part to be locked so that it is arranged behind the retaining element in the locking position;

wherein an end of a second one of said swivel arms interacts with the engagement region of the lock bolt, said lock bolt being reciprocable transversely to the pivot axis between a locking position and an unlocking position, wherein the end of said second one of said swivel arms is located outside of the engagement region of the lock bolt in the locking position and is arranged against a support inside the engagement region of the lock bolt in the unlocking position;

wherein the lock bolt comprises a spring leg parallel to its longitudinal axis, and has a compression spring coaxially surrounding said spring leg, the compression spring having a first end that presses against a supporting shoulder of the lock bolt and a second end that presses against a support that is stationary with respect to the lock bolt; and wherein the lock bolt comprises a ramp level at its ends arranged in a locking direction of said lock bolt.

* * * * *